US006972532B2

(12) United States Patent
Carter et al.

(10) Patent No.: US 6,972,532 B2
(45) Date of Patent: Dec. 6, 2005

(54) CONTROLLED MOTOR COAST IN MEDIA HANDLING SYSTEM

(75) Inventors: Daniel L. Carter, Georgetown, KY (US); Richard C. Schenk, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/440,632

(22) Filed: May 19, 2003

(65) Prior Publication Data

US 2004/0041529 A1 Mar. 4, 2004

Related U.S. Application Data

(60) Provisional application No. 60/407,218, filed on Aug. 29, 2002.

(51) Int. Cl.[7] ..... H02P 3/00

(52) U.S. Cl. ..... 318/86; 318/85; 318/41; 318/68; 318/71

(58) Field of Search ..... 318/41, 45, 68, 318/71, 86, 77; 399/256

(56) References Cited

U.S. PATENT DOCUMENTS

| | | | | |
|---|---|---|---|---|
| 4,252,307 | A * | 2/1981 | Korte | 271/4.01 |
| 4,506,321 | A * | 3/1985 | Comstock et al. | 700/69 |
| 4,955,176 | A * | 9/1990 | Seko et al. | 53/73 |
| 5,018,716 | A * | 5/1991 | Yoshida et al. | 271/227 |
| 5,291,114 | A * | 3/1994 | Shirotori et al. | 318/685 |
| 5,341,502 | A * | 8/1994 | Grossman et al. | 710/220 |
| 5,757,147 | A * | 5/1998 | Blumor et al. | 318/41 |
| 6,671,472 | B2 * | 12/2003 | Shimizu et al. | 399/82 |

* cited by examiner

*Primary Examiner*—Rita Leykin
(74) *Attorney, Agent, or Firm*—David E. Henn; Joseph M. Young

(57) ABSTRACT

By controlling all motors so that they all decelerate at substantially the same rate, buckling of media in a media handling system is substantially eliminated on shutdown. Preferably, the deceleration rate of the highest inertia motor is used as the common deceleration rate.

20 Claims, 4 Drawing Sheets

CONTROLLED MOTOR COAST IN MEDIA HANDLING SYSTEM

This application is based on a Provisional Patent Application No. 60/407,218, filed Aug. 29, 2002.

FIELD OF THE INVENTION

The invention relates to media handling in marking machines and the like. In particular, the invention relates to jam recovery.

BACKGROUND AND SUMMARY

Current xerographic marking devices and other devices that move easily-bucklable media with motor-driven rollers encounter situations in which the media stops abruptly. In such situations, the media often buckles, resulting in creases and/or folds in the media that require removal of the media. This is a relatively new problem since such machines typically included only one main drive motor.

With the arrival of more complex machines, there are often many distributed drives that will coast differently. For example, within several current print engines, there are inner rotor motors that are low inertia motors and outer rotor motors that are high inertia motors. When a jam occurs, all the motors shut off simultaneously. This causes sheets in the control of the high inertia motor to coast more than the low inertia motor controlled sheets. The worst case difference in coast can be more than six inches. Where a low inertia motor follows a high inertia motor, the sheets will overlap by the difference in coast. Once two sheets overlap, jam recovery is lost since the sensors can not identify where the edges of the sheets are when they overlap.

Embodiments ensure jam recovery when an abrupt stop occurs by, for example, controlling the coast of lower inertia drive motors to match the behavior of higher inertia drive motors. By controlling the stop of rapid-stopping motors to match the deceleration profile of the slowest stop motor, all motors slow at substantially the same deceleration. When all motors decelerate at a similar rate, all sheets will stop without buckle or additional damage. This is accomplished, for example, by implementing a controlled deceleration on the low inertia motors.

PREFERRED EMBODIMENT OF THE INVENTION

Figure 1:
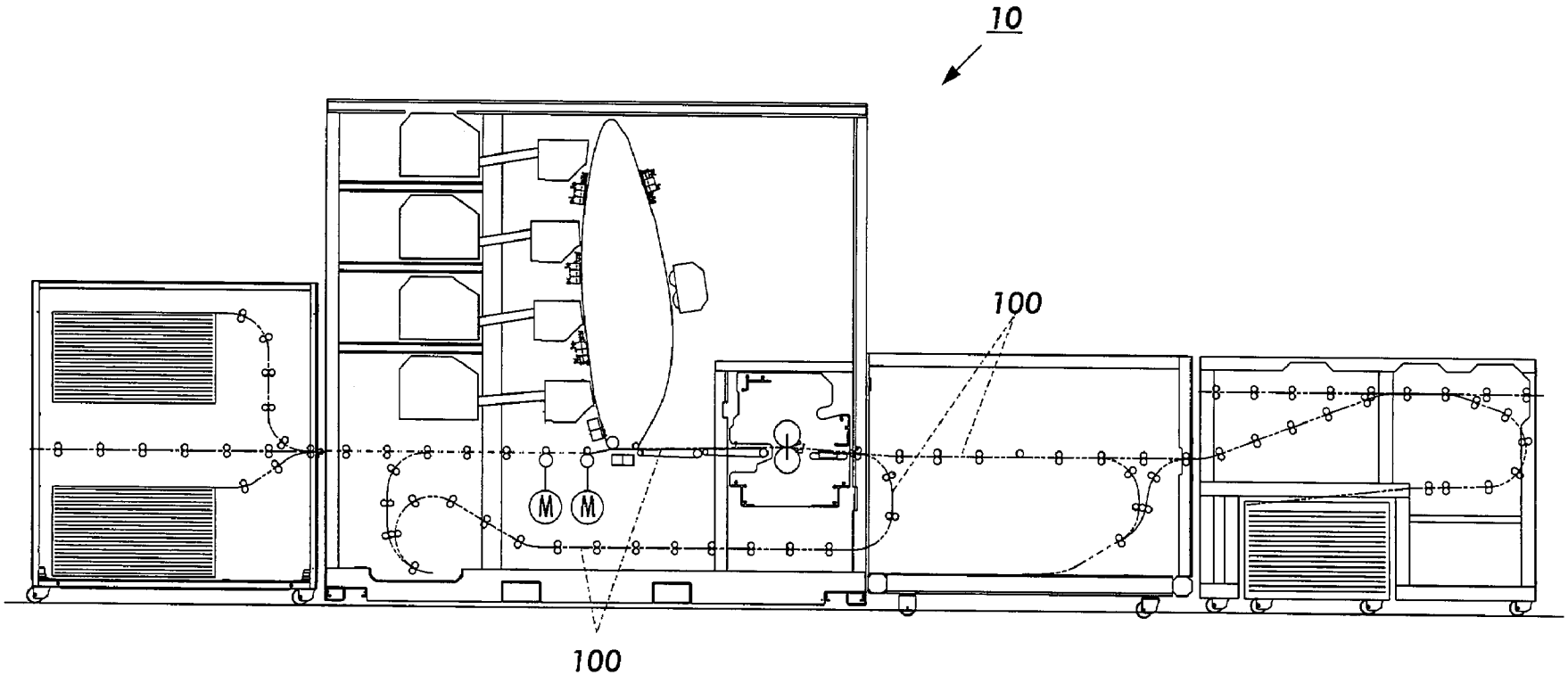
FIG. 1 is a schematic illustration of a xerographic machine in which embodiments can be employed.

As shown in the accompanying FIGS., a marking machine 10 includes a media handling system 100 including first rollers 101 and corresponding second rollers 102. The first and second rollers 101, 102 can advantageously be arranged in pairs to engage sheets of media and drive the sheets from pair to pair and from pair to machine section. The first and second rollers are shown with a vertical alignment, but these orientations are chosen for ease of illustration and by no means are intended to limit the orientations of media handling rollers that fall within the scope of the invention. In embodiments, at least one roller of each pair is driven by a drive motor 110, 120, 130. A controller 150 of the marking machine 10 controls the drive motors 110, 120, 130. In the event of a jam, the controller initiates a shutdown of the media handling system 10.

Figure 2:
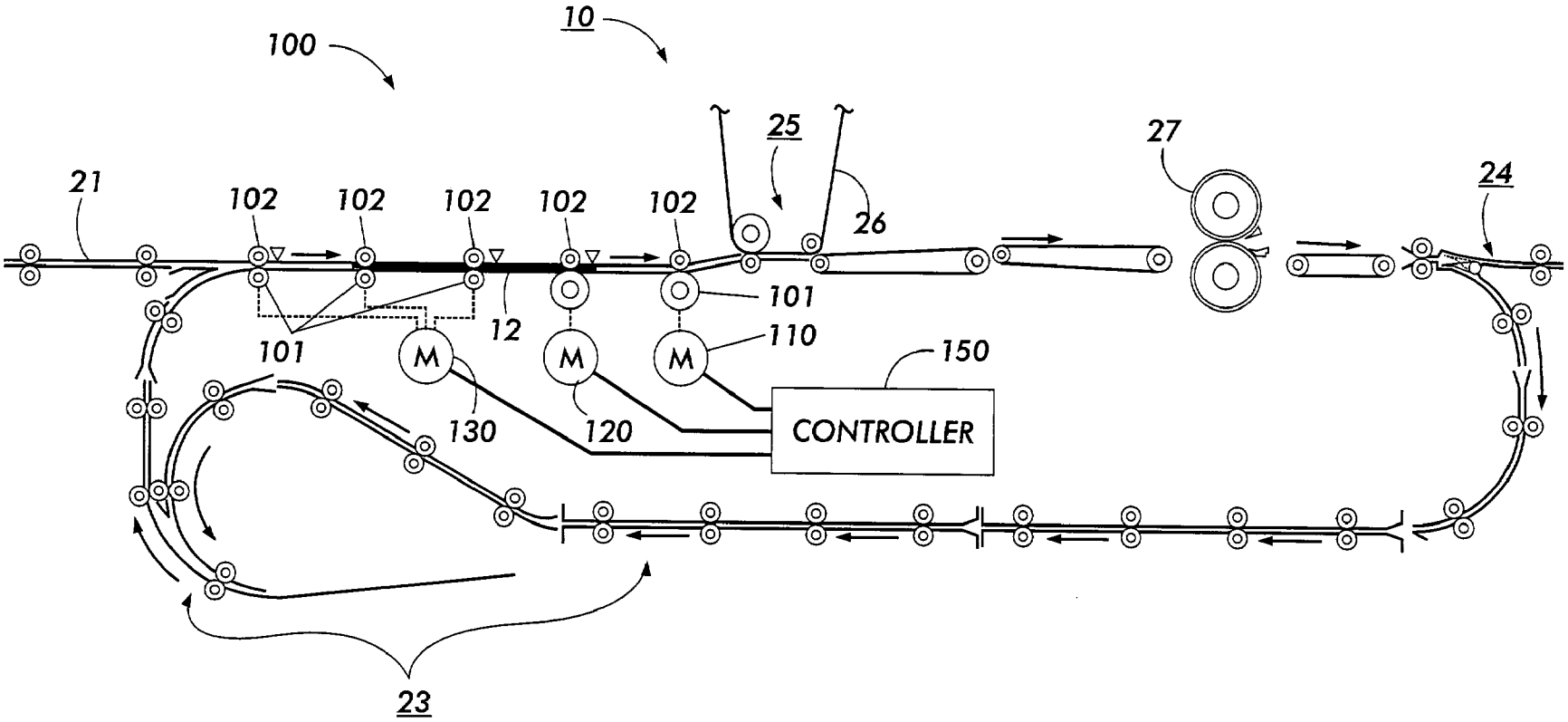
FIG. 2 is a schematic illustration of a media handling system according to embodiments.
Figure 3:
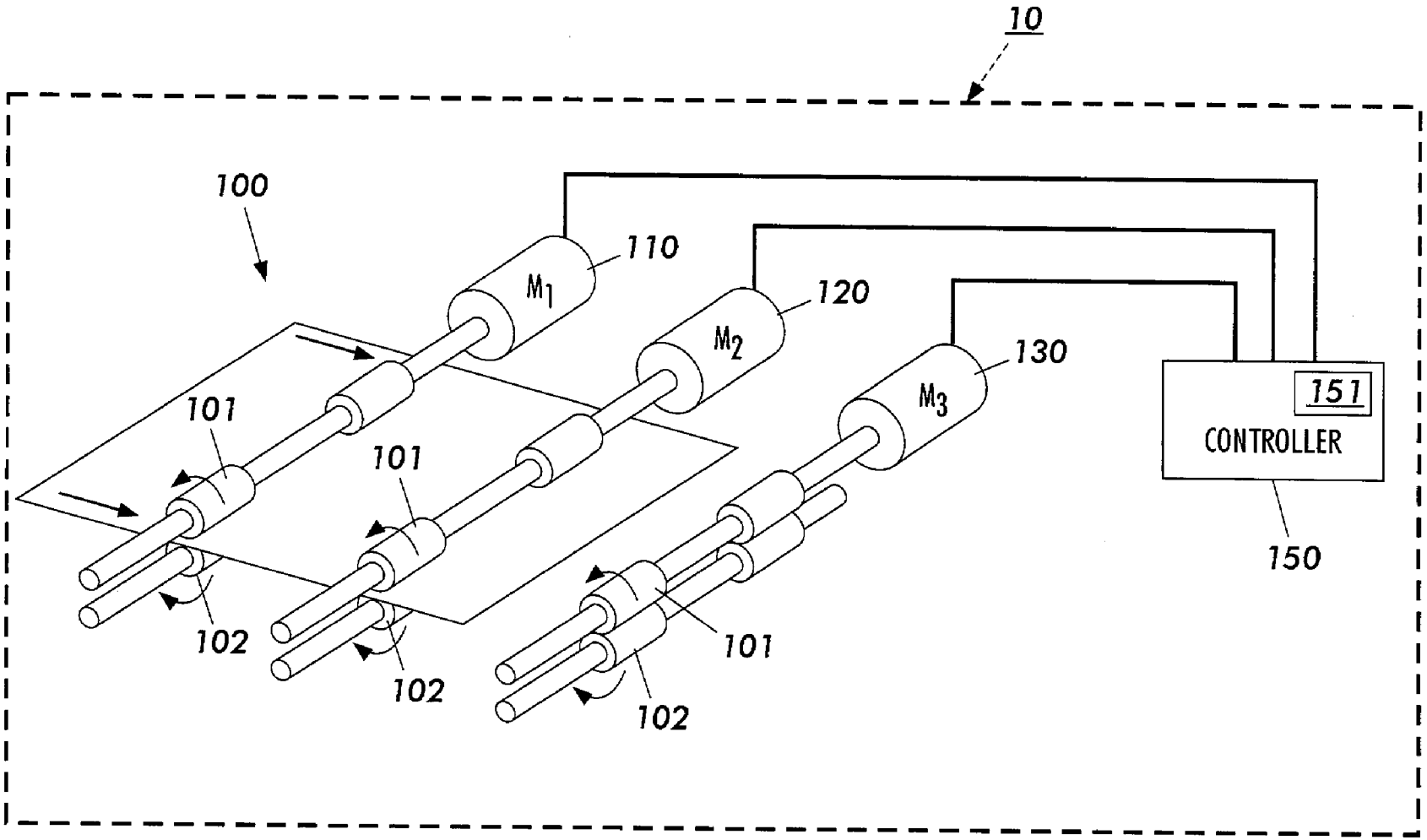
FIG. 3 is a another schematic illustration of a media handling system according to embodiments.
Figure 4:
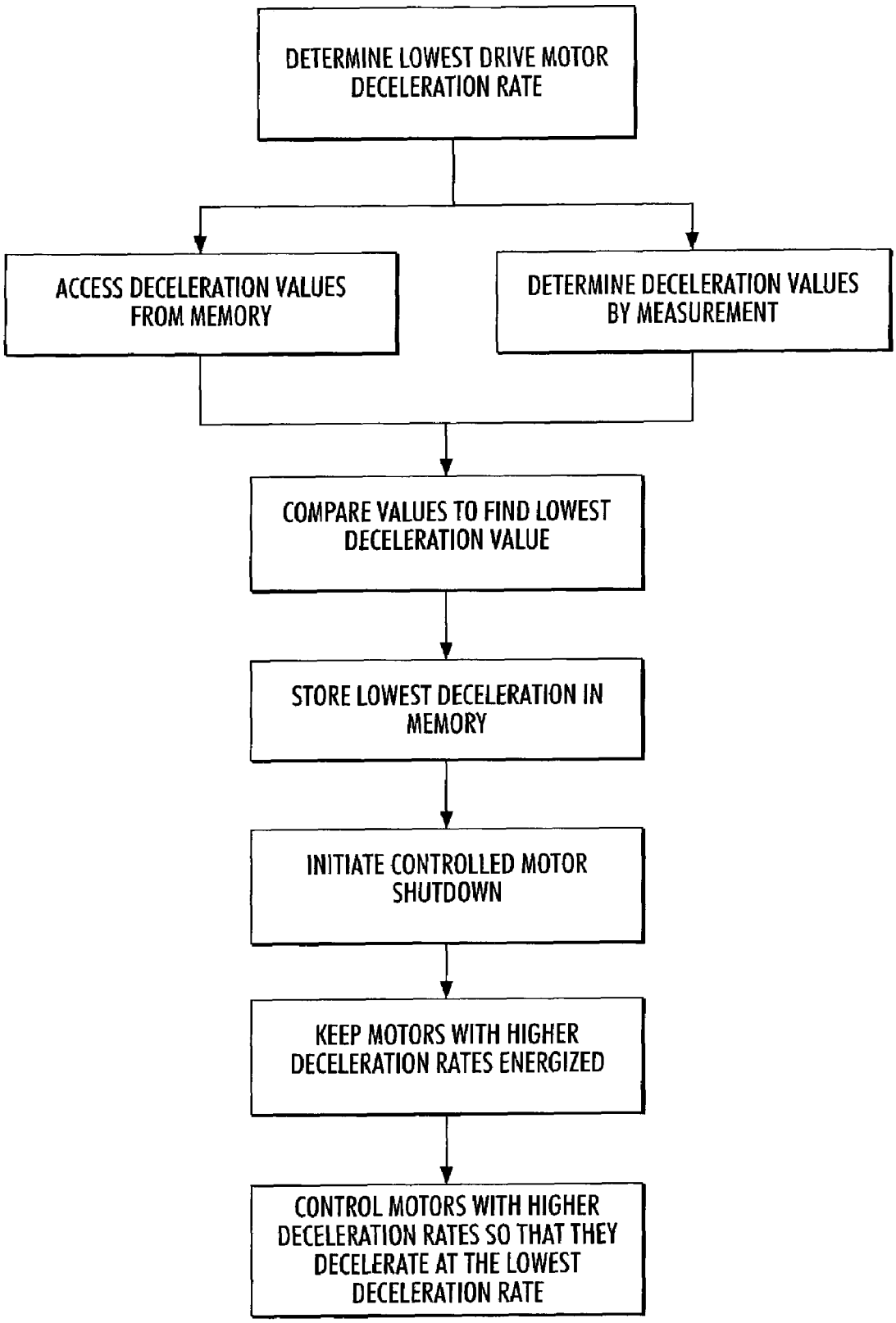
FIG. 4 is a schematic flow diagram illustrating a method according to embodiments.

In the schematic representation of a media handling system 100 shown in FIG. 2, three roller pairs are included, with the first roller 101 of each pair being driven by a respective motor. For the purposes of demonstration, assume that the first motor M1 110 is a higher inertia motor than the second motor M2 120, and that the third motor M3 130 has a lower inertia than both the first and second motors 110, 120. Embodiments would control all three motors to decelerate at the rate of M1 110 to prevent the lower inertia motors 120, 130 from slowing more quickly than M1 110.

To accomplish this, the controller 150 uses deceleration values stored in a memory 151 of the controller. The values can, for example, can be pre-loaded in the memory 151, can be acquired from the motors themselves, or can be determined by the controller. If the values are pre-loaded, then the values for the motors are determined at the factory and transferred to the memory by methods known to those of skill in the art. If the values are acquired from the motors themselves, then the values are determined at the factory and loaded into memories on the motors. When the controller needs them, it acquires the values from the memories on the motors and can store them in the memory 151 of the controller 150. If the controller determines the deceleration values, it simply monitors each motor during a shutdown to see how long the motor takes to stop from run speed and determines the respective deceleration value.

The governing equation showing that the low inertia motors coast less than the high inertia motors is $$PE_O+KE_O=PE_F+\text{Work} \qquad \text{(Eq. 1)}$$

and $$mgh_o+\tfrac{1}{2}mV_o^2+\tfrac{1}{2}IW_o^2=mgh_F+\tfrac{1}{2}mV_F^2+\tfrac{1}{2}IW_F^2 \qquad \text{(Eq. 2)}$$

where PE is potential energy, KE is kinetic energy, m is mass, g is the acceleration of gravity, h is altitude, V is speed, and W is work. These can be simplified, since $mg(h_o-h_F)\approx 1/12$ rotating energy, indicating that paper weight PE is change very small, and $\tfrac{1}{2}mV_o^2\approx 1/12$ of rotating energy, indicating that paper weight KE is also very small. Thus, after simplification, these equations only retain the work components, indicating that coast is mainly driven by rotating KE Longest Coast.

Analysis with these equations shows $$\tfrac{1}{2}I \quad W_O^2\approx T_{DRAG}\theta_{COAST}\Rightarrow(\tfrac{1}{2})(7.071\times10^{-4})(96.55)$$
$$2\approx(0.177)\theta_{COAST}\Rightarrow \qquad \theta_{COAST}\approx18.62$$
$$rad.\Rightarrow Coast\approx237 \text{ mm or } 9.34''$$

Shortest Coast:

$$\tfrac{1}{2}I \quad W_o^2\approx T_{DRAG}\theta_{COAST}\Rightarrow(\tfrac{1}{2})(2.58\times10^{-5})(152.86)$$
$$2\approx(0.056)\theta_{COAST}\Rightarrow \qquad \theta_{COAST}\approx5.38$$
$$rad.\Rightarrow Coast\approx68.6 \text{ mm or } 2.70''$$

Thus, embodiments include media handling system comprising a plurality of media drive motors, at least one drive motor controller, and a synchronizer connected to the at least one drive motor controller. The drive motor controller(s) can be part of the main controller, in embodiments. The synchronizer can also be in a main controller and is responsive to a lowest deceleration value representing a deceleration of a motor with a highest inertia, the synchronizer sending instructions to all drive motor controllers to decelerate at the lowest deceleration value. The system 100 executes a method including determining the lowest deceleration value of at least two drive motors in a sheet feed path, and decelerating all drive motors in the sheet feed path at the lowest deceleration value.

Embodiments can further comprise at least one memory in which deceleration values of each of the plurality of media drive motors are stored. The memory can be a memory 151 of the main controller 150, or each drive motor 110, 120, 130 can include a respective memory in which the motor's deceleration value is stored. For example, a controller of each drive motor can include a respective memory in which the motor's deceleration value is stored. The system 100 can be implemented in an ink jet printer media handling system, a xerographic machine media handling system, or any other media handling system in which synchronous motor deceleration can be advantageous.

Deriving respective deceleration values can include accessing a look-up table of deceleration values of the drive motors. Alternatively, deriving the deceleration values can include retrieving the respective deceleration values from the drive motors themselves, such as by retrieving the respective deceleration values from a controller controlling one or more of the drive motors. In embodiments, deriving the deceleration values can instead comprise measuring the deceleration values of the at least two drive motors, such as by initiating a shutdown of a motor and measuring the time it takes for the motor to come to rest. For example, determining the lowest deceleration value can comprise monitoring performance of the drive motors, deriving deceleration values for each of the drive motors, selecting a least of the deceleration values as the lowest deceleration value, storing the lowest deceleration value in a memory, and controlling the at least two drive motors so that all of the at least two drive motors decelerate at the lowest deceleration value.

It is appreciated that various other alternatives, modifications, variations, improvements, equivalents, or substantial equivalents of the teachings herein that, for example, are or may be presently unforeseen, unappreciated, or subsequently arrived at by applicants or others are also intended to be encompassed by the claims and amendments thereto.

What is claimed is:

1. A media handling system comprising:

a plurality of media drive motors;

at least one drive motor controller; and a synchronizer connected to the at least one drive motor controller and responsive to a lowest common deceleration value representing a deceleration of a motor with a highest inertia, the synchronizer sending instructions to all drive motor controllers to decelerate at the lowest common deceleration value.

2. The system of claim 1 wherein the drive motor controllers and the synchronizer are part of a main controller.

3. The system of claim 1 further comprising at least one memory in which deceleration values of each of the plurality of media drive motors are stored.

4. The system of claim 3 wherein each drive motor includes a respective memory in which the motor's deceleration value is stored.

5. The system of claim 3 wherein a controller of each drive motor includes a respective memory in which the motor's deceleration value is stored.

6. The system of claim 3 wherein a single memory stores all of the motors' deceleration values.

7. The system of claim 1 implemented in an ink jet printer media handling system.

8. The system of claim 1 implemented in a xerographic machine media handling system.

9. A media handling system comprising:

a plurality of media drive motors;

at least one drive motor controller; and a synchronizer connected to the at least one drive motor controller and responsive to a lowest deceleration value representing a deceleration of a motor with a highest inertia, the synchronizer sending instructions to all drive motor controllers to decelerate at the lowest deceleration value; and executing a method including:

determining the lowest deceleration value of at least two drive motors in a sheet feed path;

decelerating all drive motors in the sheet feed path at the lowest deceleration value.

10. The system of claim 9 wherein the drive motor controllers and the synchronizer are part of a main controller.

11. The system of claim 9 further comprising at least one memory in which deceleration values of each of the plurality of media drive motors are stored.

12. The system of claim 11 wherein each drive motor includes a respective memory in which the motor's deceleration value is stored.

13. The system of claim 11 wherein a controller of each drive motor includes a respective memory in which the motor's deceleration value is stored.

14. The system of claim 11 wherein a single memory stores all of the motors' deceleration values.

15. The system of claim 9 implemented in an ink jet printer media handling system.

16. The system of claim 9 implemented in a xerographic machine media handling system.

17. The method of claim 9 wherein deriving respective deceleration values comprises accessing a look-up table of deceleration values of the at least two drive motors.

18. The method of claim 9 wherein deriving respective deceleration values comprises retrieving the respective deceleration values from the at least two drive motors.

19. The method of claim 9 wherein deriving respective deceleration values comprises retrieving the respective deceleration values from at least one controller controlling the at least two drive motors.

20. The method of claim 9 wherein deriving respective deceleration values comprises measuring the deceleration values of the at least two drive motors.

* * * * *